US007121273B2

(12) United States Patent
Styles

(10) Patent No.: US 7,121,273 B2
(45) Date of Patent: Oct. 17, 2006

(54) PAINTBALL GUN AND METHOD

(76) Inventor: Leon Styles, 66 Racing Wind, Irvine, CA (US) 92614

( * ) Notice: Subject to any disclaimer, the term of this patent is extended or adjusted under 35 U.S.C. 154(b) by 0 days.

(21) Appl. No.: 11/121,893

(22) Filed: May 4, 2005

(65) Prior Publication Data

US 2005/0217652 A1 Oct. 6, 2005

Related U.S. Application Data

(63) Continuation-in-part of application No. 10/965,599, filed on Oct. 14, 2004, which is a continuation of application No. 10/452,670, filed on May 30, 2003, now Pat. No. 6,889,682.

(51) Int. Cl.
*F41B 11/00* (2006.01)

(52) U.S. Cl. ..... 124/77

(58) Field of Classification Search ..... 124/77; 42/42.02; 89/28.05, 28.1
See application file for complete search history.

(56) References Cited

U.S. PATENT DOCUMENTS 6,763,822 B1 * 7/2004 Styles ..... 124/77

* cited by examiner

*Primary Examiner*—Michael J. Carone
*Assistant Examiner*—Gabriel J. Klein
(74) *Attorney, Agent, or Firm*—Terry L. Miller

(57) ABSTRACT

A paintball gun provides a double-acting trigger apparatus including a pair of finger engagement surfaces against which a user of the gun may employ a pair of trigger fingers. The user of the paintball gun may effect a firing operation of the gun by using either one of the two fingers to pull the trigger. Consequently, rapid firing operations of the gun are effected by dithering the two trigger fingers in rapid alternating motions to apply pressure on and off the two trigger engagement surfaces. Further, the paintball gun includes a programmable, microprocessor-based controller allowing the gun to be fired in response to a chosen discreet event in time. This chosen discreet event may include the opening and/or closing of a pair of switch contacts, for example; or the making or breaking of an electrical circuit effected between conductive components of the paintball gun. Movements of the double-acting trigger apparatus will result in plural discreet events separated in time, so that plural rapid-sequence firing operations of the paintball gun may be accomplished. Accordingly, a very high cyclic rate of fire is possible with a semi-automatic paint ball gun according to this invention.

6 Claims, 10 Drawing Sheets

PAINTBALL GUN AND METHOD

CROSS REFERENCE TO RELATED APPLICATION

This application is a Continuation-in-Part of U.S. application Ser. No. 10/965,599, filed 14 Oct. 2004, which is a Continuation of U.S. application Ser. No. 10/452,670, filed 30 May 2003, now U.S. Pat. No. 6,889,682 issued May 10, 2005, and the disclosure of which is hereby incorporated by reference to the extent necessary for a full enabling disclosure of this present invention.

FIELD OF THE INVENTION

The present invention relates to a paint ball gun and method. More particularly, this invention relates to a paint ball gun having particularly advantageous apparatus and method for discharging the gun in rapid succession.

BACKGROUND OF THE INVENTION

Paint ball guns were originally developed for marking uses such as forestry and cattle ranching, in which frangible projectiles (or paint balls, as they are more commonly called) were fired against trees to be harvested or onto cattle to be taken to market, for example. For this reason, the paint ball guns themselves are frequently referred to as "markers." But, more recently paint ball guns are much more widely used in various recreational environments, such as simulated war games wherein it is the intent to shoot at an opposing player with the paint ball gun, thus hitting and marking this opposing player with a particular color of paint splattered from a frangible paint ball.

Paint ball guns using compressed air or gas for power are well known. Until recently, most paint ball guns were pneumatically powered, mechanically operated guns. The entry of electro-pneumatically operated paint ball guns provided more consistent and better performing guns for the recreational market. An electro-pneumatic paint ball gun provides improved performance with fewer component malfunctions than the earlier mechanical-pneumatic paint ball guns.

However, a common problem with the conventional electro-pneumatic paint ball guns is that they use a mechanical sear device to release a hammer. The hammer is spring loaded to a position at which it impacts a valve stem, opening a flow path for high pressure gas to communicate to a paint hall, propelling the paint ball through and from a barrel of the gun. The adjustment of the engagement and release of the mechanical hammer and sear remains an uncertain element of conventional paint ball gun operation, requiring frequent adjustments in order to operate at high cyclic rates.

A more recent paint ball gun is shown in U.S. Pat. No. 6,532,949 (hereinafter, the "949" patent). In the '949 patent, a hammer of a paint ball gun is moved in each of two opposite directions by respective ends of a rod member, to which respective pneumatic pressures are applied sequentially by a solenoid valve. In this '949 patent, the hammer must be moved in each direction of its stroke by a respective pneumatic pressure, and these respective pneumatic pressures must be sequentially controlled by a solenoid valve.

Further, a deficiency of conventional paint ball guns becomes apparent when attempts are made to achieve a high cyclic rate of fire. That is, competition rules prohibit the operation of paint ball guns in a full-automatic mode in which the gun cycles many times and fires many paint balls with a single pull or movement of the trigger. In full-automatic mode, a paint ball gun would continue firing paint balls as long as the trigger is pulled and held, and as long as its ammunition supply lasts. But, competition uses of such full-automatic paint ball guns is prohibited, and only semi-automatic guns are allowed in which a single paint ball is fired for each pull of the gun trigger.

Nevertheless, paint ball players desire to achieve a high rate of fire with semi-automatic paint ball guns. This is desired in order to provide the highest chance of obtaining hits on dodging and running competitors in paint ball competition. This rapid semi-automatic paint ball gun fire is ordinarily attempted by "vibrating" or shaking the trigger fingers against a two-fingered trigger structure of the conventional paint ball gun.

An improved apparatus and method for allowing rapid firing of a semi-automatic paint ball gun is desired.

SUMMARY OF THE INVENTION

In view of the deficiencies of the related art, it is an object for this invention to mitigate or eliminate at least one of these deficiencies.

Specifically, it is an object for this invention to provide a semi-automatic paintball gun with a very high cyclic rate of fire.

Still another object for this invention is to provide such a paint ball gun in which a microprocessor controller may be accessed by the user of the paint ball gun in order to select determined discreet events separated in time and which will result when they occur in a firing operation of the paintball gun.

The present invention according to a particularly preferred exemplary embodiment provides a paint ball gun having a body carrying a barrel, the body includes a grip frame, and a double-acting trigger apparatus. This double-acting trigger apparatus comprises a pair of finger-engagement surfaces moving in opposition to one another and defining a neutral non-firing position. Also, the trigger apparatus providing a pair of firing positions displaced from the neutral position and each of which can be accessed by finger pressure on a respective one of the pair of finger-engagement surfaces. A device closing an electrical circuit in response to movement of the trigger apparatus to either one of said pair of firing positions is included, and a controller is associated with the trigger apparatus for effecting a firing action of the gun to discharge a paint ball from the barrel in response to closing of the electrical circuit.

Additional objects and advantages of the present invention will become apparent to those ordinarily skilled in the pertinent arts upon reading the following detailed description of a particularly preferred embodiment of the invention, which illustrates the best mode contemplated for practicing the invention, taken in conjunction with the accompanying drawings.

Figure 1:
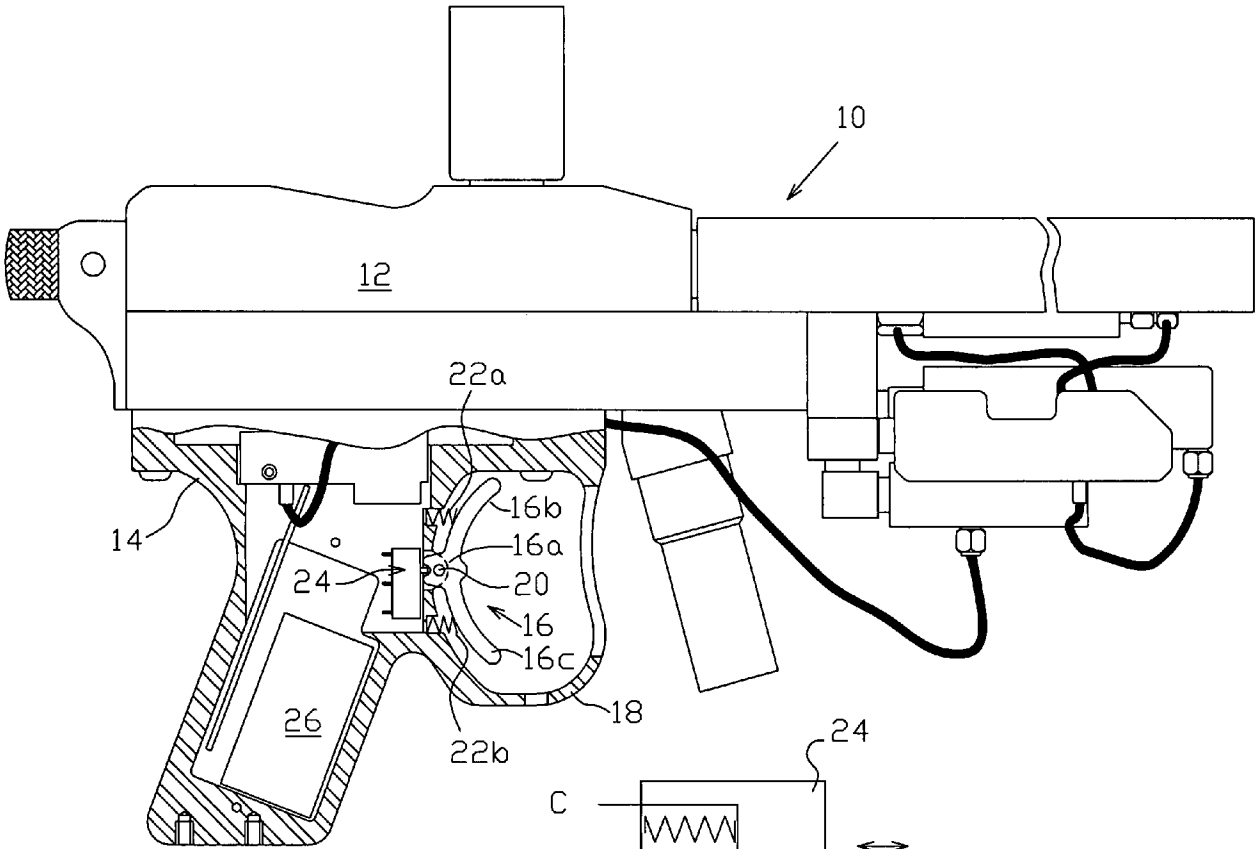
FIG. 1 is a side elevation view, partially in cross section, of a paint ball gun embodying the present invention, and showing a trigger of the paint ball gun in a "neutral" or non-firing position
Figure 2A:
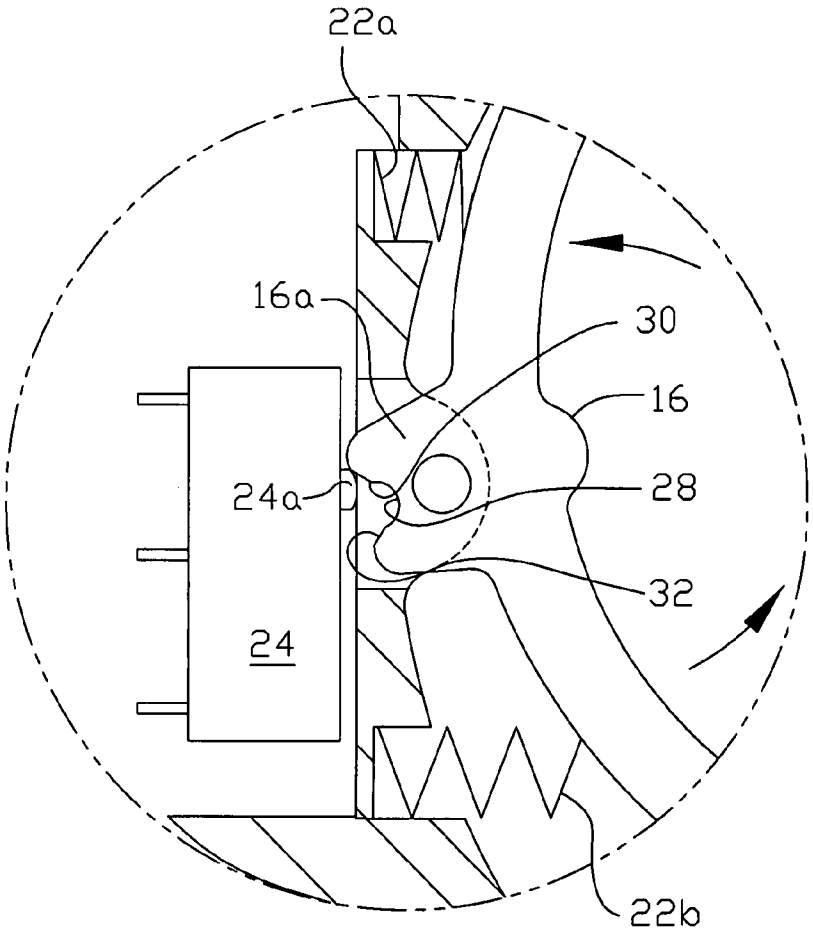
FIGS. 2 and 3 are fragmentary side elevation views, partially in cross section, of the paint ball gun seen in FIG.
Figure 2:
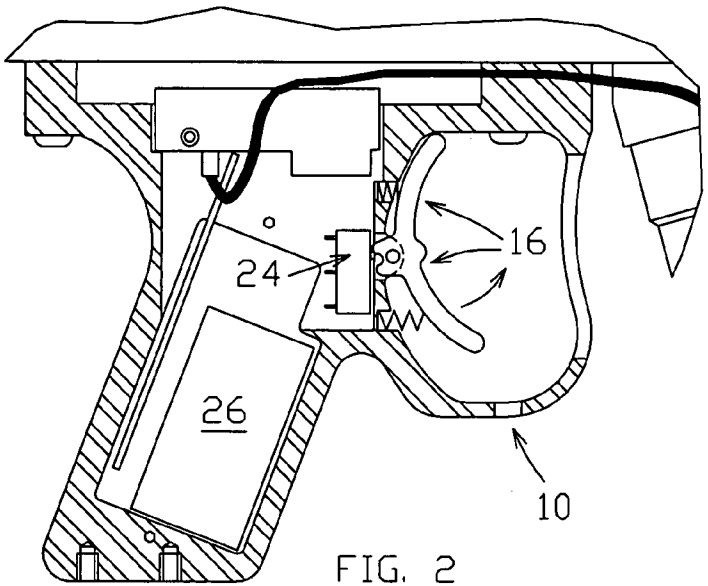
Figure 4:
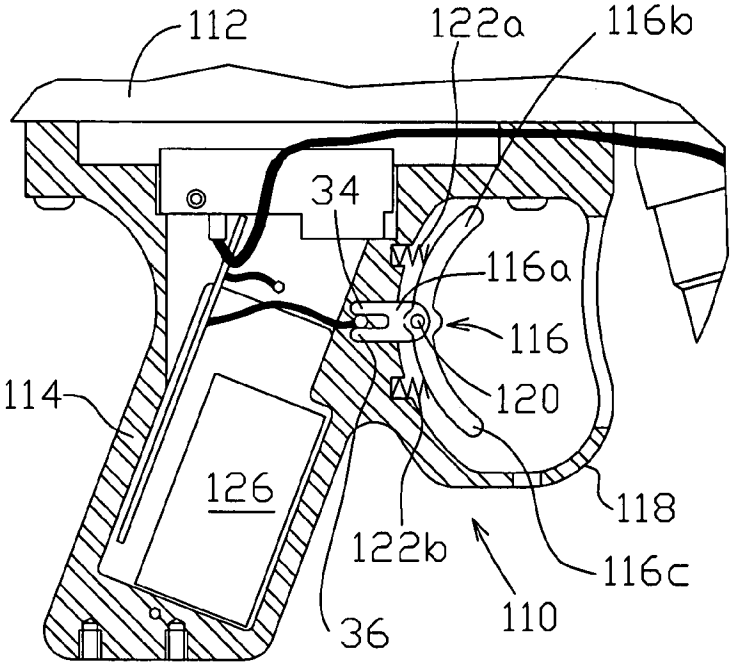
Figure 4A:
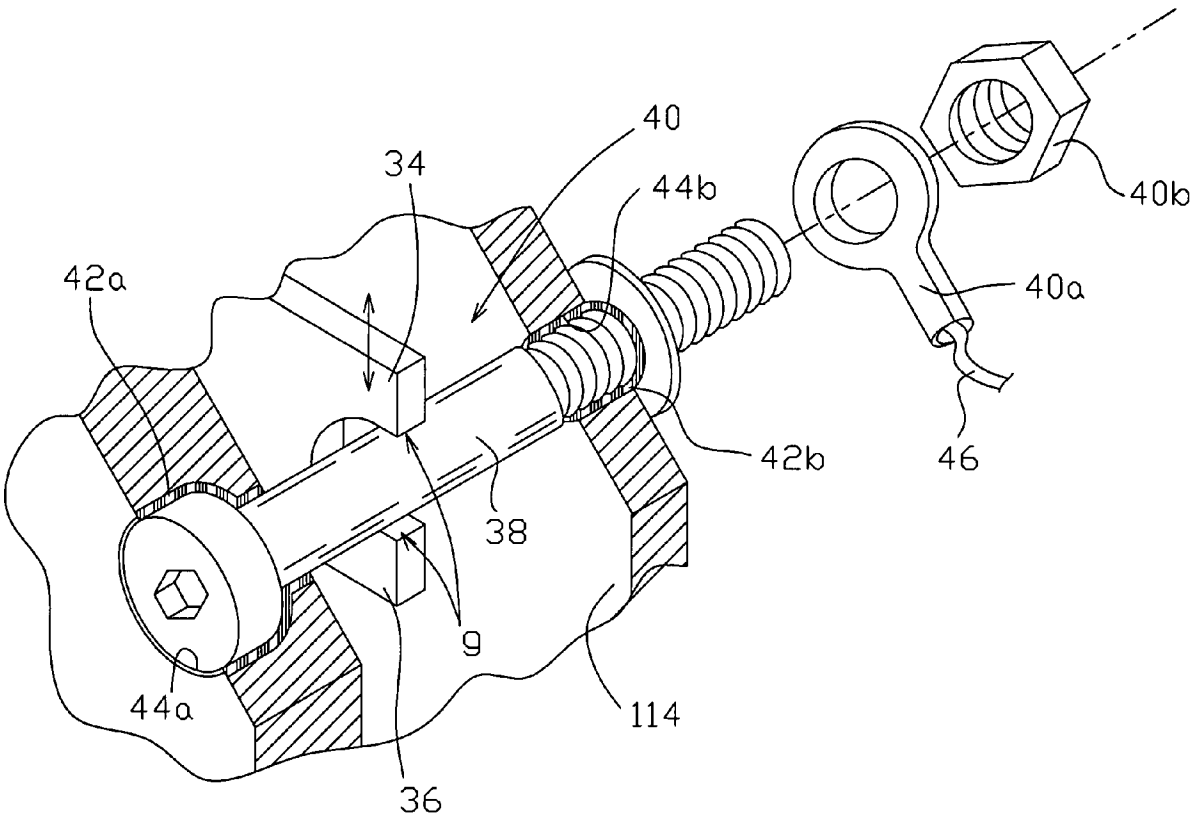
Figure 6:
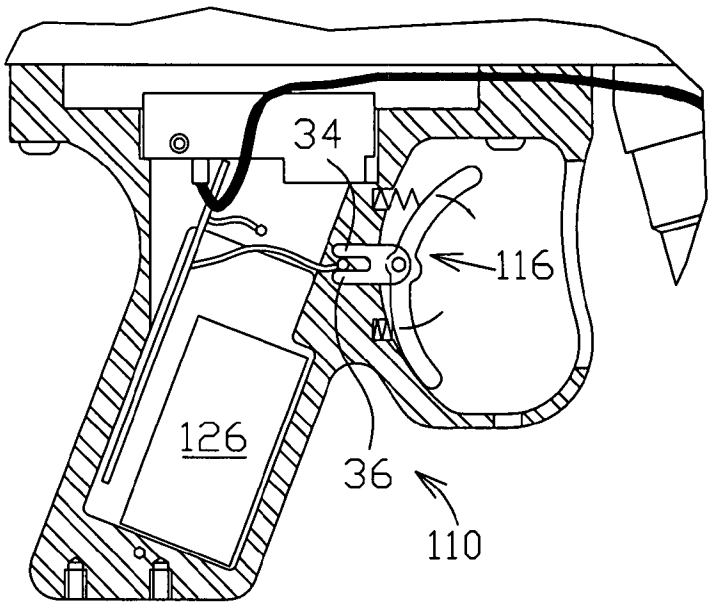
Figure 5:
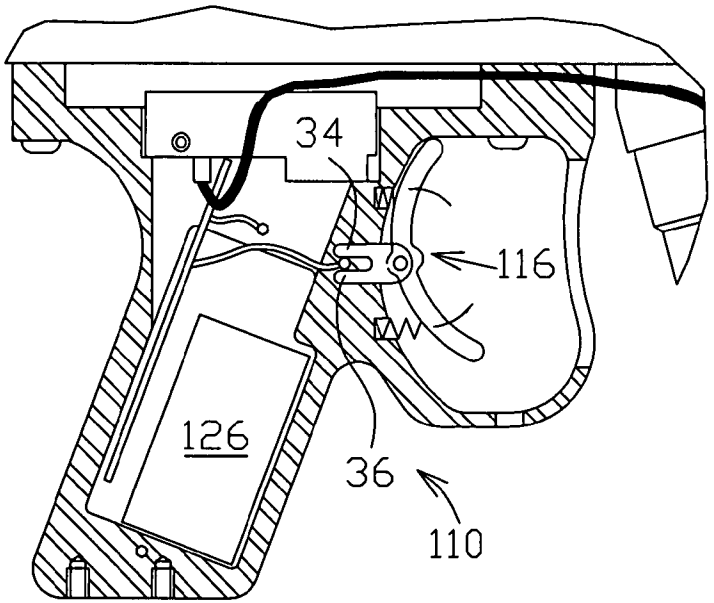
Figure 7:
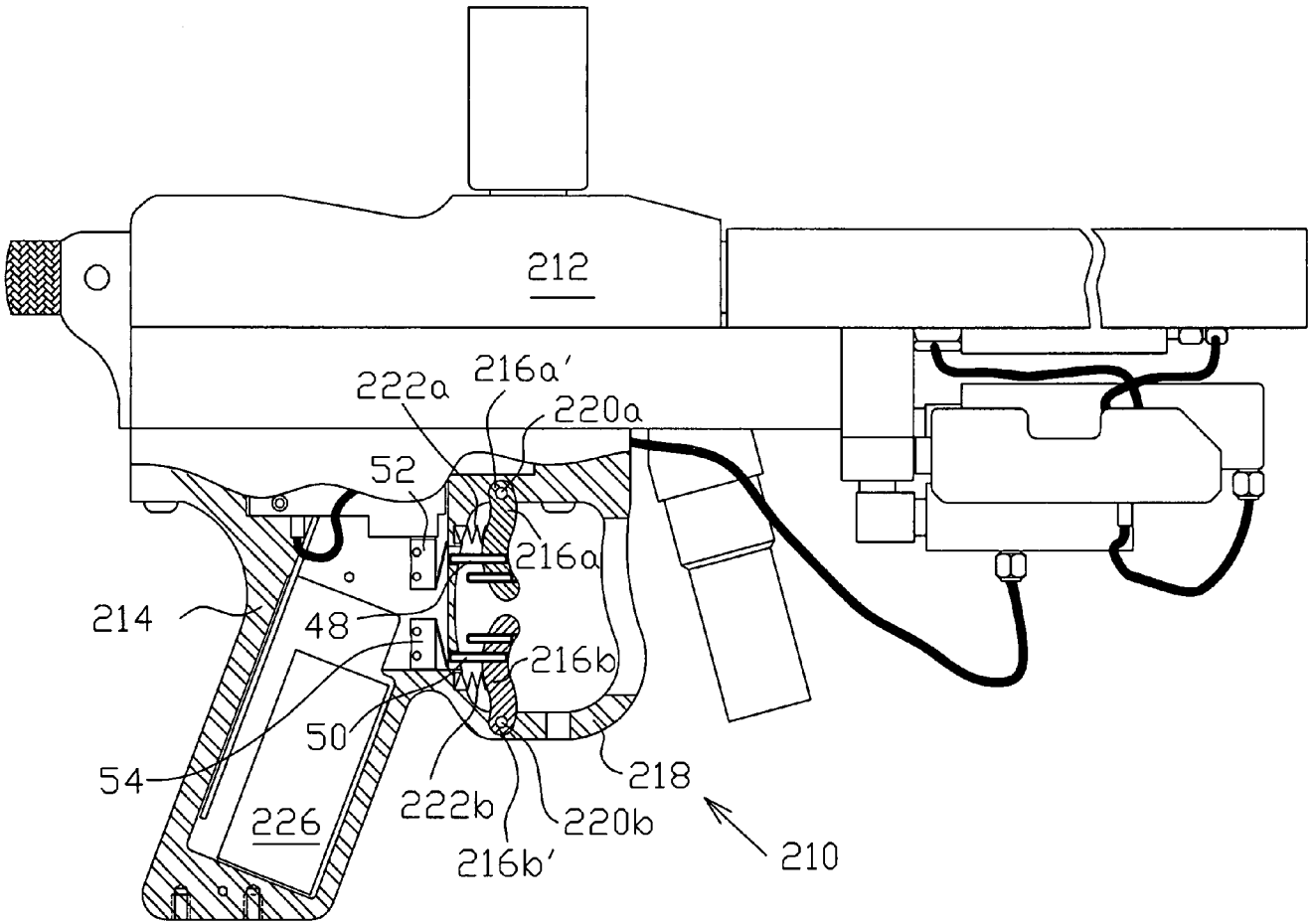
Figure 8:
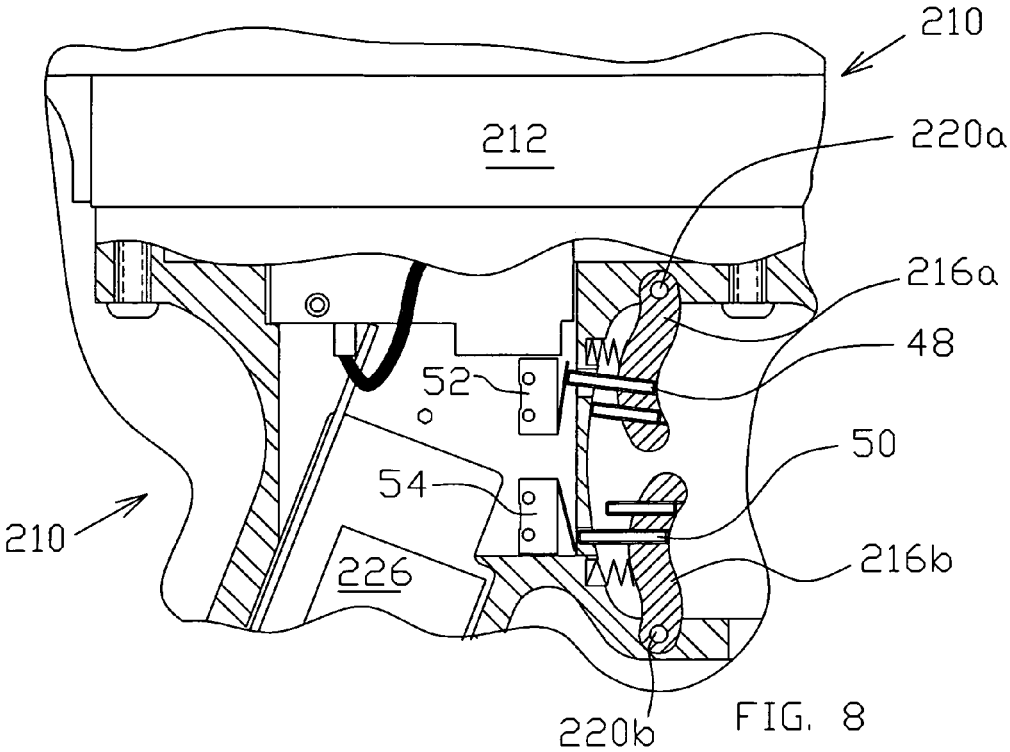
Figure 9:
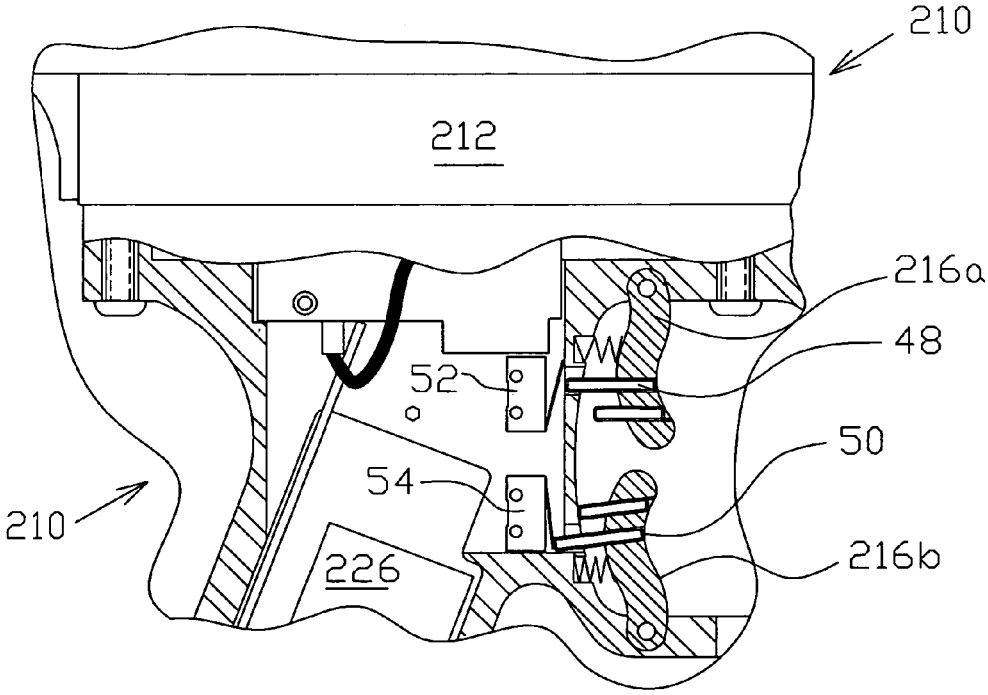
Figure 10:
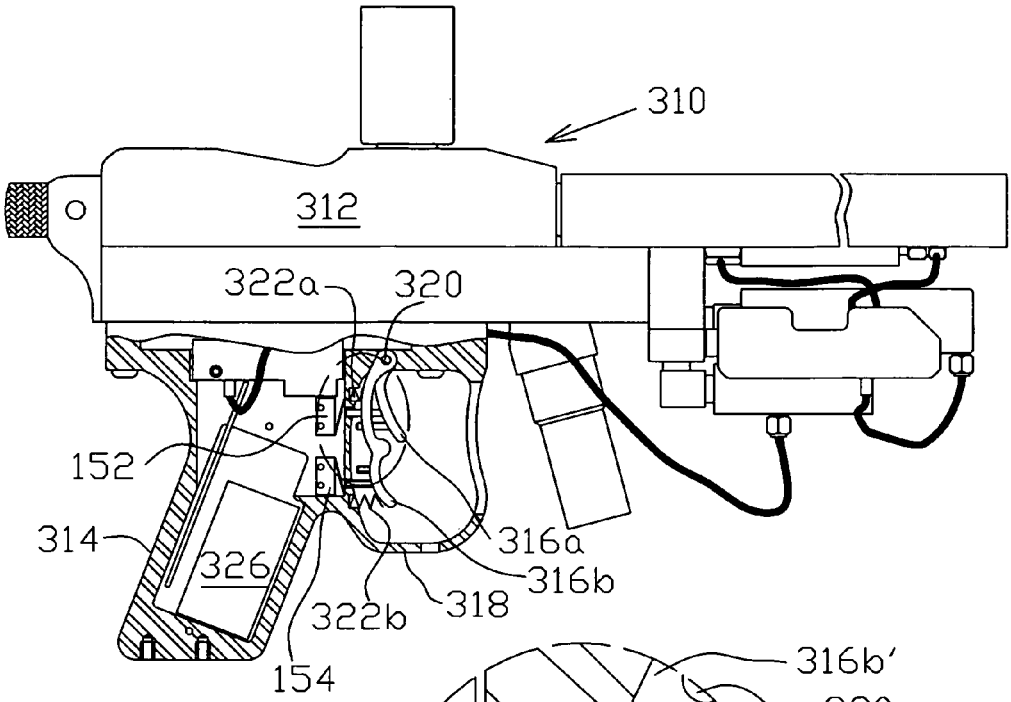
Figure 10A:
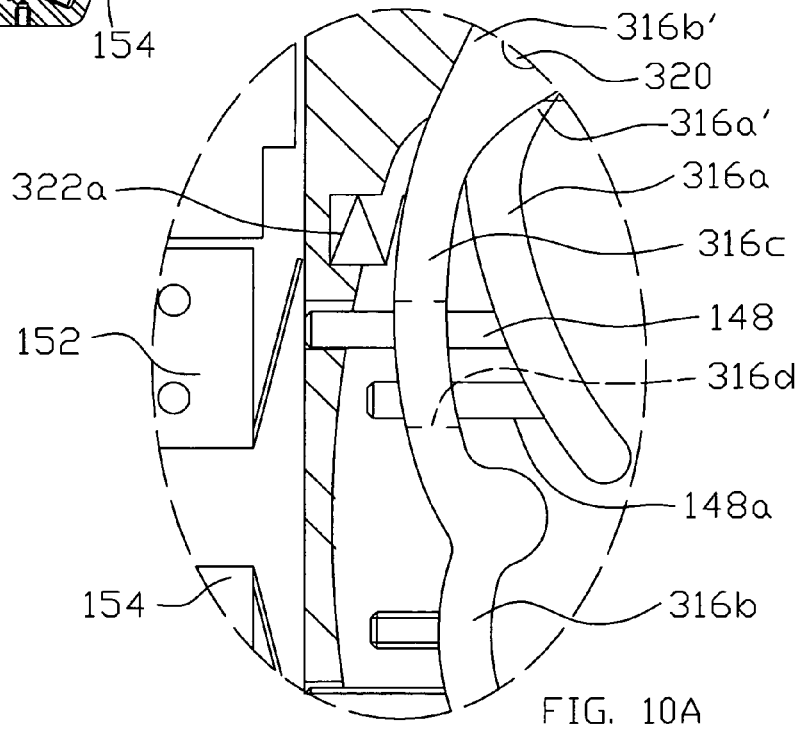
Figure 11:
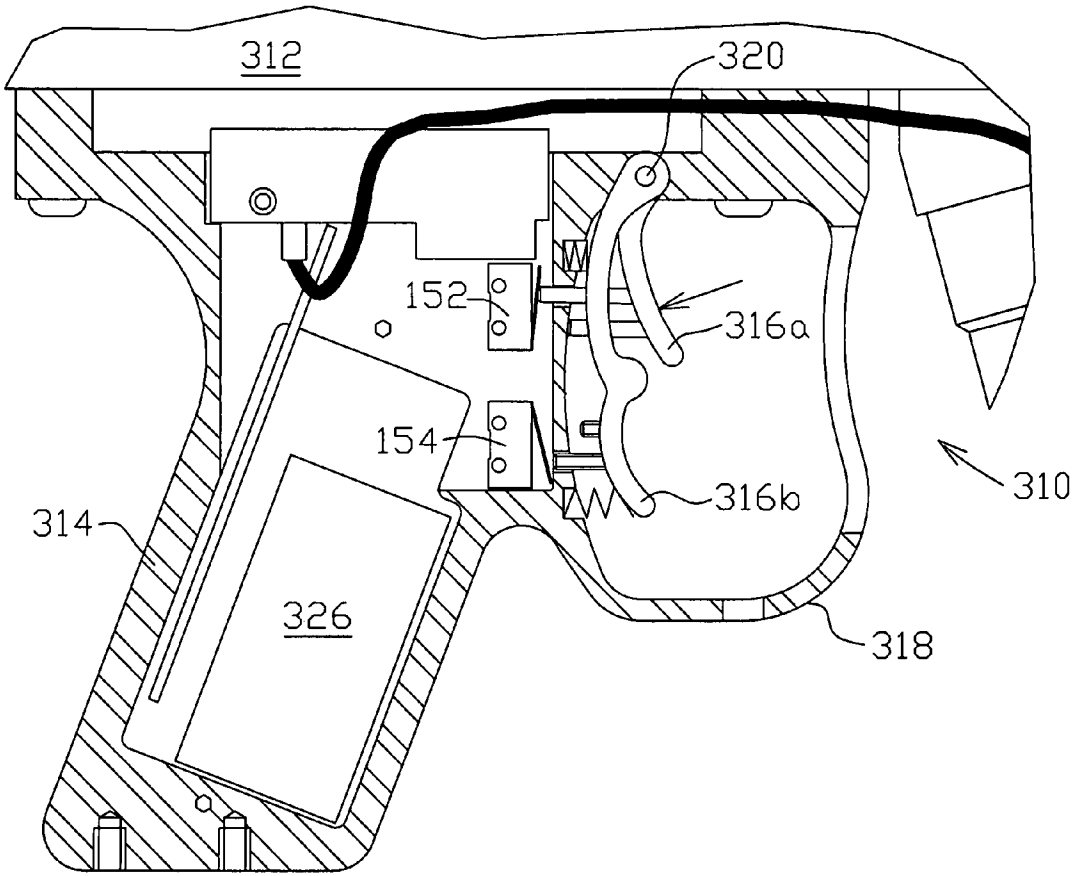
Figure 12:
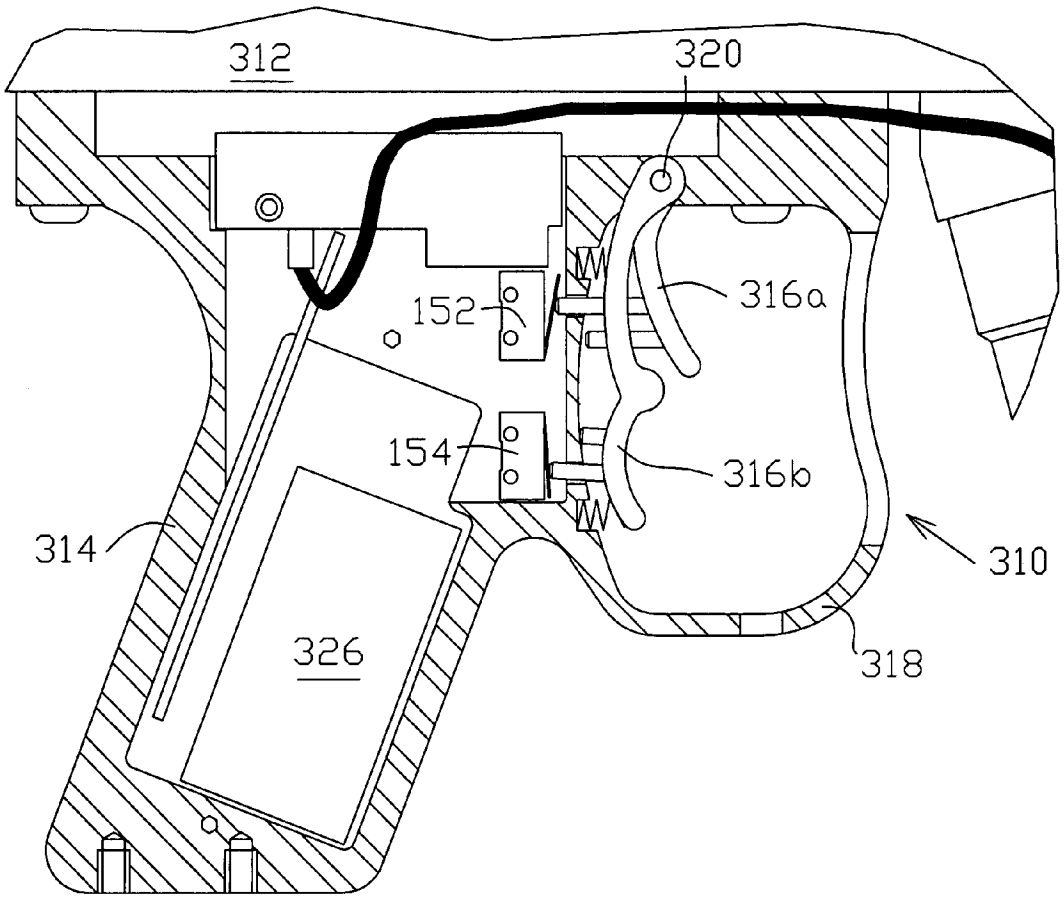

1, and respectively showing the trigger in a first firing position displaced from the neutral position in one direction, and in a second firing position displaced from the neutral position in an opposite direction;

FIG. 2A is an enlarged side elevation view of an encircled portion of FIG. 2, and shows the "camming" or "ramping" interaction of one of a pair of opposed inclined surfaces on a trigger structure of the paint ball gun with an actuating stem or stud of a trigger switch;

FIG. 4 is a side elevation view, partially in cross section, of a paint ball gun according to a second embodiment of the present invention, and shows a trigger of the paint ball gun in a "neutral" on non-firing position;

FIG. 4A is an enlarged fragmentary perspective view of an encircled portion of FIG. 4, with portions broken away for clarity of illustration, and shows the opposed "contact" surfaces defined by a trigger structure of the paint ball gun as they cooperate with an electrified stem or stud of the paint ball grip frame to form an electrical circuit;

FIGS. 5 and 6, respectively, are fragmentary side elevation views, partially in cross section, of the paint ball gun seen in FIG. 4, and respectively show a trigger of the paint ball gun displaced to a first firing position from the neutral position of FIG. 1, and to a second firing position displaced from the neutral position of FIG. 1 in an opposite direction;

FIG. 7 is a side elevation view, partially in cross section, of a paint ball gun according to a third embodiment of the present invention, and shows a pair of independently pivotal triggers of the paint ball gun both in a "neutral" on non-firing position;

FIGS. 8 and 9, respectively, are fragmentary side elevation views, partially in cross section, of a paint ball gun as seen in FIG. 7, and respectively show a pair of independently pivotal triggers of the paint ball gun in a first firing position with one trigger displaced from its neutral position to effect a firing of the paint ball gun, and in a second firing position with the other trigger displaced from its neutral position in order to alternatively effect a firing of the paint ball gun;

FIG. 10 is a side elevation views, partially in cross section, of a paint ball gun according to a fourth embodiment of the present invention, and shows a pair of pivotal triggers sharing a common pivot axis with each trigger in a neutral or non-firing position, and with each trigger being arranged and configured to be actuated by only one of a pair of fingers of a user;

FIG. 10A is a greatly enlarged view of an encircled portion of FIG. 10;

FIGS. 11 and 12, respectively, are fragmentary side elevation views, partially in cross section; of the paint ball gun seen in FIG. 10, and showing one trigger in a first firing position displaced from its neutral position to effect a firing of the paint ball gun, and with the other trigger displaced to a second firing position from its neutral position in order to alternatively effect a firing of the paint ball gun.

DETAILED DESCRIPTION OF THE EXEMPLARY PREFERRED EMBODIMENTS

Considering first FIGS. 1–3, and FIG. 1A, and 2A in conjunction with one another, a paint ball gun 10 with a unique rocking trigger structure is illustrated. This paint ball gun 10 includes a main body 12, with a grip frame 14 carrying a center-pivot or rocking trigger 16 shielded within a trigger guard 18. The trigger 16 is engageable by at least a pair of fingers of the operator of the gun 10, and will be seen to be double-acting, as will be further explained. Considering the rocking trigger 16 it is seen that this trigger defines a boss 16*a* pivotally connected by a pin 20 to the grip frame 14. In this embodiment, the trigger 16 is yieldably centered in the position seen in the subject drawing Figures by the cooperation of two coil compression springs 22*a* and 22*b* each received into a corresponding recess in the grip frame 14 and acting against oppositely extending trigger wings 16*b* and 16*c* of the trigger 16. These trigger wings 16*b* and 16*c* provide for a user of the paint ball gun 10 to effect firing operations of the gun by pivoting or rocking the trigger 16 in either direction from the illustrated neutral (or non-firing) position seen in FIG. 1. These two alternative firing positions are respectively illustrated in FIGS. 2 and 3.

Figure 1A:
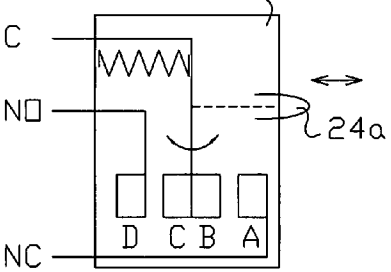
FIG. 1A is a schematic illustration of a switch of the paint ball gun of FIG. 1.

As is seen in FIGS. 1 and 1A, the paint ball gun 10 includes a single micro switch 24, having a stem or stud 24*a* axially movable or reciprocable relative to the body of this switch. Most preferably, the switch 24 is of single-pole, double-throw (SPDT) configuration so that movement of the stem 24*a* in one direction effects opening of a first pair of switch contacts (AB in FIG. 1A) and the closing of a second pair of switch contacts (CD in FIG. 1A) within the micro switch 24. It will be noted that the opening and closings of the switch contacts just mentioned are not truly simultaneous, but are separated in time from one another by a very brief interval. Similarly, when the stem 24*a* is moved in the opposite direction, the second pair of contacts (CD) opens, followed a brief interval later by the first pair of contacts (AB) re-closing.

Attention to FIG. 1A will show that the pairs of contacts of switch 24*a* are indicated with the reference characters A, B, C, and D, and that these "pairs" of contacts are made up of an electrical contact between the switch contacts AB on the one hand, and of switch contacts CD on the other hand. So, it is to be appreciated that when one pair of contacts AB or CD is closed, that pair must first open (which is a first discreet event) followed a very short time later by the other pair of contacts (AB or CD) closing (which is a second discreet event following in time after the first event).

Figure 3:
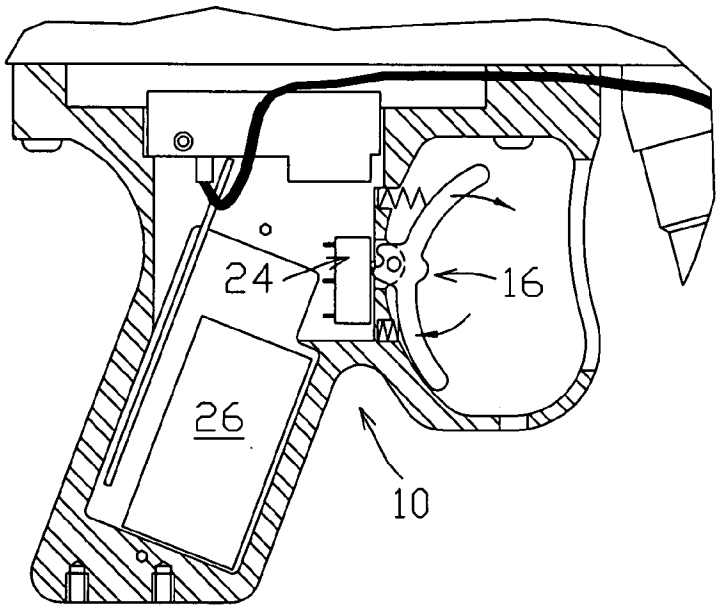

Preferably, with each switch contact closure (i.e., a contact closure input, or CCI), a microprocessor-based control system 26 of the gun 10 effects a firing operation of the gun 10. As FIGS. 2 and 3 illustrate, rapid successive switch closures of the micro switch 24 may be effected by successive opposite rocking motions of the trigger 16. That is, FIG. 2A shows that the boss 16*a* defines a recess 28 receiving a distal end portion of the switch stem 24*a*, and providing a pair of oppositely extending sloping cam surfaces 30, 32 extending in opposite directions along the sides of recess 28. As FIG. 2A illustrates, a respective one of these two cam surfaces 30, 32 is brought into engagement with the stem 24*a* in response to pivoting of the trigger 16 in order to effect reciprocation of the switch stem 24*a*.

It will be apparent to those ordinarily skilled in the pertinent arts that the other of the two cam surfaces 30, 32 (i.e., other than the one shown engaged with switch stem 24*a* in FIGS. 2 and 2A) may also effect reciprocation of the switch stem 24*a*, will result in a CCI, and a firing of the gun 10, in response to pivoting of the trigger 16 in the opposite direction, as is seen in FIG. 3. Accordingly, a user of the gun 10 may effect rapid successive firings of the gun by successive rocking motions of the trigger 16 in successively opposite directions from the neutral position seen in FIG. 1 (i.e., to the positions seen in FIGS. 2 and 3). Each rocking motion from the neutral position to either one of the firing positions seen in FIGS. 2 and 3 cause the gun 10 to fire one paintball.

Further to the above, it will be appreciated that the controller 26 of the paint ball gun 10 may be programmed to effect a firing of the gun both in response to a contact closure input (CCI) as explained above, and also in response to a contact opening input (COI). That is, the controller 26 can be programmed to effect a firing operation of the paint ball gun 10 in response to the voltage transient accompanying both a CCI, and also accompanying a COI, each of which are discreet events inherently separated in time because of the nature of the switch 24, as explained above. And still alternatively, both sets or pairs (AB, and CD—recalling FIG. 1A) of switch contacts of the micro switch 24 may be connected to the controller 26 so that both sets of contacts AB and CD when closing provide a CCI input to the controller 26 (as well as both sets of contacts when opening also providing a COI input to the controller 26). That is, the controller 26 may be programmed to not effect a firing operation of the paint ball gun 10 in response to either a maintained contact closure (CCI), or in response to a maintained contact open condition (COI), but to effect a firing of the gun 10 in response to either or both transient event.

Further to the above, in the way described below, the firing operations of the paint ball gun in response to rocking motions of the rocking trigger 16 may instead of causing the gun 10 to fire once for each rocking motion in a particular direction, may cause the gun 10 to fire either two, three, of four times in response to each rocking motion of the trigger 16 from its neutral position to one of the firing positions seen in FIGS. 2 and 3. That is, with a micro switch 24 such as the one seen in FIG. 1A, the two pair of switch contacts AB and CD each open and close in sequence, with one switch contact pair opening, followed a split second later by the other switch contact pair closing. Thus, the contact opening and closing sequence for the two pairs of switch contacts consists of four events in time sequence (AB open, CD close, CD open, AB close), and any one or more of these events may be arranged to cause the gun 10 to fire through appropriate programming of the processor 26.

For example, if the gun 10 is to fire twice on a single rocking motion (i.e., movement from neutral position to either one of the two alternative positions seen in FIGS. 2 and 3), then the controller 26 may be arranged to fire once when the first set of contacts closes, and to fire the second time either when that first set of contacts opens, or when the other set of contacts closes.

On the other hand, if four paint ball shots are desired for each rocking motion of the trigger 16 from its neutral position to one or the other of the two firing positions, then a shot is fired for each of: the opening of one of the pair of switch contacts, followed by the closing of the other pair of switch contacts, and the opening of the other of the pair of contacts, followed by the closing of the one pair of switch contacts (i.e., first when AB opens, then later when CD closes, and still later when CD opens, and finally when AB closes). Those ordinarily skilled will appreciate that the time intervals between these events are very, very short, but are not of zero time in length.

As outlined above then, although the paintball gun 10 is not "full automatic" in operation because a discreet input movement by the gun operator is required for each shot fired, and the maintenance of a particular firing input will not result in the repeated firing of the gun (in contrast to the case of a full automatic gun, in which simply holding the trigger pulled once results in the gun firing continuously and repeatedly until its ammunition runs out). However, the cyclic rate of fire of the gun 10 which can be achieved with the paintball gun 10 in response to rapid trigger dithering or rocking movements by the gun operator is unmatched by any conventional paintball gun.

Turning now to FIGS. 4–6, and FIG. 4A, an alternative embodiment of the invention is depicted. In order to obtain reference numerals for use in describing this alternative embodiment of the invention, features which are the same as or analogous to those depicted and described by reference to the first embodiment of the invention are indicated on FIGS. 4–6 and 4A with the same reference numeral used above, and increased by one-hundred (100).

Considering now FIGS. 4–6, and FIG. 4A, in conjunction with one another a paint ball gun 110 with an inventive rocking trigger apparatus is depicted. This paint ball gun 110 includes a main body 112, with a grip frame 114 carrying a center-pivot or rocking trigger 116 shielded within a trigger guard 118. Considering the rocking trigger 116 it is seen that this trigger defines a boss 116*a* pivotally connected both physically and electrically by a pin 120 to the grip frame 114. In this embodiment, the trigger 116 is yieldably centered in the position seen in FIGS. 4 and 4A by the cooperation of two coil compression springs 122*a* and 122*b* each received into a corresponding recess in the grip frame 114 and acting against oppositely extending trigger wings 116*b* and 116*c* of the trigger 116. Again, these trigger wings 116*b* and 116*c* provide for a user of the paint ball gun 110 to effect firing operations of the gun by pivoting or rocking the trigger 116 in either direction from the illustrated neutral (or non-firing) position seen in FIGS. 4 and 4A. These two alternative firing positions are respectively illustrated in FIGS. 5 and 6.

Viewing particularly FIGS. 4 and 4A, it is seen that the trigger 116 includes as part of boss 116*a* a pair of spaced apart rearwardly extending and spaced apart substantially parallel blades 34, 36. Received between this spaced apart pair of blades 34, 36 is a shank portion 38 of a bolt-like contact member 40 carried by the grip frame 114 of the paint ball gun 110. The shank portion 38 may be cylindrical as shown in FIGS. 4–6, and FIG. 4A, although the invention is not so limited. Importantly, the contact member 40 is carried by and is electrically insulated from the main body and grip frame 112, 114, of the paint ball gun by a pair of insulating bushing members 42*a*, 42*b* each received into a respective bore 44*a*, 44*b* defined by the grip frame 114. A threaded portion of the contact member 40 threadably engages into the busing 42*b* in order to secure the bushings 42*a*, 42*b* and contact member 40 in the frame 114. The contact member 40 is electrically connected by a connector 40*a*, wire 46, and securing nut 40*b* to the microprocessor-based controller 126.

As is best illustrated in FIG. 4A, in the neutral or non-firing position of the trigger 116, the blades 34, 36 each define a fine-dimension (or small) gap "g" with the shank portion 38 of the contact member 40. So, it will be appreciated that the contact member 40 is analogous to switch contact members "B" and "C" illustrated schematically in FIG. 1A. Similarly, the blades 34 and 36 may be considered analogous to the switch contact members "A" and "D" illustrated in FIG. 1A. Understandably then, as the trigger 116 is pivoted in either direction from its neutral or non-firing position, to either one of the firing positions seen in FIGS. 5 and 6, then one of the gaps "g" is closed, and one of the respective pair of blades 34, 36 makes physical and electrical contact with the contact member 40. As is seen in FIG. 4A, and as was mentioned above, an electrical conductor or wire 46 connects to the contact member 40, making this contact member one side of a circuit, the other side of which includes the grip frame 114 and trigger 116. Thus, the blades 34, 36 are included on one side of an electrical circuit and the contact member 40 is included on the other side of this electrical circuit. Accordingly, the blades 34, 36, and contact member 40 define a switch mechanism. This switch mechanism serves the function of controlling the controller 126, just as was the case with micro switch 24 of the first-described embodiment.

It follows that when a user of the paint ball gun 110 rocks the trigger 116 from side to side on opposite sides of the neutral or non-firing position seen in FIG. 4, and alternatingly in succession to the firing positions seen in FIGS. 5 and 6, firing operations of the paint ball gun are effected by the controller 126. Similarly to the first-described embodiment, the user of the paintball gun 110 may choose by appropriate programming of the processor 126 to have the gun 10 fire one, two, three, or four shots with each rocking motion of the trigger 116 through its two alternative firing positions.

Turning now to FIGS. 7–9 yet another alternative embodiment of the invention is depicted. In order to obtain reference numerals for use in describing this third alternative embodiment of the invention, features which are the same as or analogous to those depicted and described by reference to the first or second embodiment of the invention are indicated on FIGS. 7–9 with the same reference numeral used above, and increased by two-hundred (200).

Considering now FIGS. 7–9 in conjunction with one another, a paint ball gun 210 with an inventive double trigger arrangement is depicted. This paint ball gun 210 includes a main body 212, with a grip frame 214 carrying a pair of oppositely-pivoted triggers 216*a* and 216*b*, both shielded within a trigger guard 218. Considering the pair of oppositely-pivoted triggers 216*a* and 216*b* it is seen that these triggers each define one of a respective pair of boss portions 216*a*' and 216*b*' pivotally connected by a respective pin 220*a* and 220*b* to the grip frame 214. As is seen in FIGS. 7–9, the triggers 216*a* and 216*b* are pivoted to the grip frame 214 at spaced apart locations, with one being pivoted at the top of the grip frame 214, while the other is pivoted at the bottom of this grip frame 214. As a result, the triggers 216*a* and 216*b* extend in opposite directions into the trigger area within the trigger guard 218. One of the triggers is dependent within the trigger guard 218, while the other trigger extends upwardly from a lower portion of the trigger guard 218.

In this embodiment, each of the triggers 216*a* and 216*b* is yieldably biased to a neutral or non-firing position seen in FIG. 7 by a respective one of two coil compression springs 222*a* and 222*b* each received into a corresponding recess in the grip frame 214 and acting against the respective trigger 216*a* or 216*b*. Each trigger 216*a* and 216*b* cooperates with a respective push rod member 48, 50 to actuate a respective one of a pair of micro switches 52, 54. Again, these micro switches electrically connect with a microprocessor-based controller 226, which effects a firing action of the gun 210 when either one of the switches 52, 54 is activated by pivoting motion of one of the triggers 216*a*, 216*b* from the neutral position seen in FIG. 7, to either one of the two firing positions seen in FIGS. 8 and 9.

Turning now to FIGS. 10–12, and FIG. 10A, yet another (or fourth) alternative embodiment of the invention is depicted. In order to obtain reference numerals for use in describing this fourth alternative embodiment of the invention, features which are the same as or analogous to those depicted and described by reference to the first, second, or third embodiment of the invention are indicated on FIGS. 10–12, and FIG. 10A with the same reference numeral first used above, and increased by three-hundred (300).

Considering now FIGS. 10–12, and FIG. 10A in conjunction with one another, a paint ball gun 310 with an inventive double trigger arrangement is depicted. This paint ball gun 310 includes a main body 312, with a grip frame 314 carrying a pair of commonly-pivoted triggers 316*a* and 316*b*, both shielded within a trigger guard 318. Considering the pair of commonly-pivoted triggers 316*a* and 316*b* it is seen that these triggers each define a respective a boss portion 316*a*' and 316*a*' pivotally connected by a single common pivot pin 320 to the grip frame 314. As is seen in FIGS. 10–12, the triggers 316*a* and 316*b* are pivoted to the grip frame 314 at a single top location, so that each trigger 316*a* and 316*b* shares the same "or common" pivot axis. As a result, the triggers 316*a* and 316*b* both depend into the trigger area within the trigger guard 318, but the trigger 316*b* includes an upper portion 316*c* which is somewhat concealed or recessed behind the trigger portion 316*a*. This upper portion 316*c* defines an opening or slot (indicated by dashed lines and the arrowed numeral 316*d* in FIG. 10A) through which a push rod 148 and trigger stop rod 148*a* both extend. Consequently, the fingers of a user of the paint ball gun 310 can contact and actuate the trigger 316*a*, and can also contact and actuate the lower portion of trigger 316*b*.

Again, in this embodiment also, each of the triggers 316*a* and 316*b* is yieldably biased to a neutral or non-firing position seen in FIG. 10 by a respective one of two coil compression springs 322*a* and 322*b* each received into a corresponding recess in the grip frame 314 and acting against the respective trigger 316*a* or 316*b*. Each trigger 316*a* and 316*b* co-acts with a respective push rod member 148, 150 to actuate a respective one of a pair of micro switches 152, 154. Again, these micro switches electrically connect with a microprocessor-based controller 326, which effects a firing action of the gun 310 when either one of the switches 152, 154 is activated by pivoting motion of one of the triggers 316*a*, 316*b* from the neutral position seen in FIG. 10, to the firing positions seen in FIGS. 11 and 12.

While the invention has been described in connection with what is presently considered to be the most practical and preferred embodiment, it is to be understood that the invention is not to be limited to the disclosed embodiments but is intended to be limited only by the spirit and scope of the appended claims, giving full cognizance to equivalents, and to cover various modifications and equivalent arrangements as is permitted under the law.

What is claimed is:

1. A paint ball gun having a body carrying a barrel, said body including a grip frame, and a double-acting trigger apparatus, said double-acting trigger apparatus comprising a pair of finger-engagement surfaces moving in opposition to one another and defining a neutral non-firing position, and said trigger apparatus providing a pair of firing positions displaced from said neutral position and each of which can be accessed by finger pressure on a respective one of said pair of finger-engagement surfaces, a singular switch closing an electrical circuit in response to movement of said trigger apparatus to either one of said pair of firing positions, and a controller associated with said trigger apparatus for effecting a firing action of said gun to discharge a paint ball from said barrel in response to closing of said electrical circuit.

2. The paint ball gun of claim 1 wherein said trigger apparatus includes a pair of oppositely extending integral trigger wings each providing a respective one of said pair of finger-engagement surfaces, and said device closing an electrical circuit in response to movement of said trigger apparatus to either one of said pair of firing positions including a switch actuation of which effects a firing action of said gun, said trigger apparatus including a boss engaging said switch to effect actuation of said switch in response to movements of said trigger apparatus to either one of said pair of firing positions.

3. The paint ball gun of claim 2, wherein said switch includes a plunger movable between a first and a second position to effect actuation of said switch, and said boss including a recess receiving said plunger and including a pair of oppositely extending ramp surfaces each engageable with said plunger to actuate said switch in response to movement of said trigger apparatus to either one of said pair of firing positions.

4. A method of operating a paint ball gun, said paint ball gun including a body carrying a barrel, a grip frame, and a double-acting trigger apparatus, said method comprising steps of:

providing said double-acting trigger apparatus with a pair of finger-engagement surfaces moving in opposition to one another;

providing said double acting trigger apparatus with a neutral non-firing position;

providing for said double-acting trigger apparatus to move to each one of a pair of firing positions each displaced from said neutral position;

allowing a user of said paint ball gun to access each of said pair of firing positions by finger pressure on a respective one of said pair of finger-engagement surfaces; and utilizing a singular switching device to close an electrical circuit in response to movement of said trigger apparatus to either one of said pair of firing positions to effect a firing action of said paint ball gun;

whereby said firing action of said paint ball gun discharges a paint ball from said barrel.

5. The method of claim 4 further including the steps of: configuring said double-acting trigger apparatus to include a pair of oppositely extending integral trigger wings each providing a respective one of said pair of finger-engagement surfaces.

6. The method of claim 5 further including the steps of: providing said singular switch with a plunger movable between a first and a second position to effect actuation of said switch, and providing said trigger apparatus with a boss including a recess receiving said plunger and including a pair of oppositely extending ramp surfaces, and in response to movement of said trigger apparatus to either one of said firing positions engaging a respective one of said ramp surfaces with said plunger and actuating said switch.

* * * * *